US006971861B2

(12) United States Patent
Black et al.

(10) Patent No.: US 6,971,861 B2
(45) Date of Patent: Dec. 6, 2005

(54) HIGH SPEED UNLOADER FOR GAS COMPRESSOR

(76) Inventors: Arthur L. Black, 61 Nassau Dr., Rockport, TX (US) 78382; Gene M. Thompson, 13459 Pine Dr., Cypress, TX (US) 77429

( * ) Notice: Subject to any disclaimer, the term of this patent is extended or adjusted under 35 U.S.C. 154(b) by 126 days.

(21) Appl. No.: 10/368,886

(22) Filed: Feb. 19, 2003

(65) Prior Publication Data

US 2004/0159807 A1 Aug. 19, 2004

(51) Int. Cl.[7] ..... F04B 23/00; F16K 31/00

(52) U.S. Cl. ..... 417/440; 417/446; 417/510; 251/64

(58) Field of Search ..... 417/440, 446, 417/510, 520; 251/64

(56) References Cited

U.S. PATENT DOCUMENTS 2,626,100 A * 1/1953 McIntyre ..... 417/44.7
4,632,145 A * 12/1986 Machu ..... 137/516.21
4,869,291 A * 9/1989 Hrabal ..... 137/516.21

* cited by examiner

*Primary Examiner*—Charles G. Freay
(74) *Attorney, Agent, or Firm*—Jackson Walker L.L.P.; Mark A. Tidwell, Esq.

(57) ABSTRACT

A piston system for a reciprocating compressor is adapted for high speed, high pressure unloading conditions by providing a dual stage piston assembly wherein the piston is adapted for absorbing and redistributing a portion of the load during the high pressure applications or high pressure portion of a cycle without reducing the efficiency of the system during normal loads. Pressure of up to 4000 psi can be handled without damage to the piston or other valve components. The valve plate is held in the closed position by a compression spring which is adapted to be engaged by a finger/driver upon reciprocation of the valve piston. The finger driver moves with the piston against the valve plate to open the valve on the plunger downstroke and move away from the valve on the plunger upstroke. A shock absorbing element is positioned in the plunger/finger assembly to absorb the shock of the driving downstroke, thereby reducing the shock of the finger against the valve plate.

32 Claims, 2 Drawing Sheets

HIGH SPEED UNLOADER FOR GAS COMPRESSOR

BACKGROUND OF THE INVENTION

1. Field of the Invention

The subject invention is related to high speed and medium speed reciprocating compressors for pipeline transmission, power generation and other applications requiring large horsepower drivers and compression capacity and is specifically directed to a high speed, high pressure dual stage unloader for unloading engines with a high differential pressure.

2. Discussion of the Prior Art

Compression allows a well to produce higher volume of gas, generating higher revenues. In some cases, compression is required for a well to produce at all.

Reciprocating separable compressors for this application are well known and are typically designed to pair with electric motors and natural gas engines as a cost effective method of compression for pipeline transmission, power generation and other applications requiring large horsepower drivers and compression capacity. Typical compressors are designed for various high-horsepower applications that include gas gathering, pipeline transmission, gas storage and high-pressure gas injection projects.

The reciprocating, piston type compressor typically includes a reciprocating piston, wherein as the piston nears the bottom of its stroke within the cylinder, the intake valve opens for drawing gas into the cylinder. As the piston rises, the increased pressure closes the intake valve. Then as the piston nears the top of its stroke, the exhaust valve opens permitting the gas at the higher pressure to exit. Reciprocating compressor capacity is a function of the bore and stroke of the piston-cylinder configuration as well as the speed of the machine and compression ratio.

Large, medium and high speed reciprocating compressors are designed to pair with electric motors and natural gas engines to provide a cost effective method of compression for many applications. A typical reciprocating compressor and compressor system is available from Ariel Corporation, Mount Vernon, Ohio.

The mechanical design is rugged and reliable but has one significant limitation. It will damage the valves on the compression stroke and possibly the compressor itself if not within strict design limits. As typical compressor configurations are used in higher pressure, in higher speed applications this condition becomes more critical.

There is a need for regulation permitting high speed unloading using common reciprocating compressor configurations. This is true because of the large number of compressors in the field at the present time, wherein retrofitting is a far more efficient solution than replacement. This is also true because in many applications the high-speed unloading sequence is only present during part of the operation cycle and the ability to handle the higher load is not continuously required. This permits use of a lower rated compressor for the application even though peak load may be harmful to the compressor in occasional portions of the cycle.

SUMMARY OF THE INVENTION

The subject invention is directed to an enhanced unloading system for a reciprocating compressor adapted for high speed, high pressure unloading conditions. This is accomplished by providing for absorbing and redistributing a portion of the load during the high pressure applications or high pressure portion of a cycle without reducing the efficiency of the system during normal loads. In the preferred embodiment of the invention, high pressure of up to 4000 psi can be handled without damage to the piston valves or other cylinder components.

In the preferred embodiment of the invention, the valve plate is held in the closed position by a compression spring which is adapted to be engaged by a finger/driver upon reciprocation of the valve piston. The finger driver moves with the piston against the valve plate to open the valve on the plunger downstroke and move away from the valve on the plunger upstroke. A shock absorbing element is positioned in the plunger/finger assembly to absorb the shock of the driving downstroke, thereby reducing the shock of the finger against the valve plate.

Specifically, by cushioning the finger force the destructive action and force against the valve plate is substantially reduced without reducing the speed or the load on the system.

In the preferred embodiment, the shock absorbing element is mounted in a cavity provided in the plunger assembly near the outer or driven end of the plunger. A shock absorbing element is placed in the cavity and is designed to expand and contract with the stroke of the plunger as the plunger cycles. The shock absorbing element is engaged on one side by the plunger and on the opposite side by the bore stop surface. This permits the shock absorbing element to be activated and operational during the entire stroke of the plunger, expanding and contracting with the motion of the plunger to fill the gap defined by the cavity.

In the preferred embodiment, the gap is adjustable to increase or decrease the stroke and to increase or decrease the load on the shock absorbing element. The shock absorbing element may be any of a variety of expandable load bearing elements. In the preferred embodiment, mechanical spring washers are used. One example is a disk washer made of spring steel and biased along the center axis to form a truncated cone shape. A common washer of this type is the Belleville washer. By placing a plurality of such washers in an axially aligned and opposed stacking arrangement, a wide range of load bearing and load absorbing configurations may be devised. Typically, a fixed spacer will be used in combination with the washer assembly to fill and control the size of the cavity gap.

In operation, when the valve plunger is driven toward the valve plate, the finger will move with the plunger against the valve plate and open the valve. In high pressure operations, a prior art finger will "slam" against the valve plate and cause premature fatigue. This is particularly true since the valve plate is typically made of a softer material than the finger. Using the enhanced finger drive system of the subject invention, the shock absorbing element absorbs a portion of the load normally distributed to the valve plate by the finger, thus reducing the load on the valve plate and extending its life. This is accomplished without reducing the load on the valve assembly and without reducing the stroke of the plunger or the finger/driver.

This permits modification of the compressor system by installing a modified plunger driver system in the bore without altering any other components in the assembly. Specifically, the finger/driver, valve plate, outer assembly and bore are not altered, only the plunger is altered to accommodate the shock absorbing element in a cavity defined by a modified ring assembly at the driver end of the plunger.

The enhanced driver assembly of the subject invention permits the compressor system to be used for higher pressure, higher speed applications. This is particularly true since the valve plate is typically the weakest component in the system and the valve rating is based on the load carrying capacity of the valve plate. By reducing the load on the valve plate, the differential load and higher valve velocity may be handled without surpassing the rated loads on the valve plate.

In the preferred embodiment, the main shaft of the plunger assembly is adapted to accommodate an outer ring which is of a C-shaped cross-section with a center hole for receiving the main shaft. It is desirable for the shaft and center hole to be threaded for securing the ring to the shaft. The outer ring is located in the same position as the stop ring of the prior art and the stop location or length of stroke may be controlled by adjusting the axial position of the ring relative to the shaft.

In the assembly of the subject invention, the ring does not engage the stop surface at the end of the stroke until the shock absorbing assembly is compressed. Thus, as the drive shaft reciprocates, the shock absorbing element is expanded and compressed as the cavity increases and decreases in size. This absorbs a portion of the load normally carried by the shaft and the finger/driver assembly mounted on and moving with the shaft. This, in turn, reduces the load translated from the finger/driver to the valve plate. Further, this is accomplished without reducing the finger stroke or the overall load on the system.

The size of the gap may be controlled by rigid spacers and/or by the threaded positioning of the ring on the drive shaft. The amount of load to be absorbed may be controlled by selection of the load bearing capacity of the shock absorbing element.

It is, therefore, an object and feature of the subject invention to provide a high speed unloader for a high pressure reciprocating compressor valve.

It is also an object and feature of the subject invention to provide a dual stage drive system for reducing the load on a valve plate in high pressure applications of a reciprocating compressor.

It is another object and feature of the subject invention to provide an apparatus for absorbing and distributing a portion of the load on a piston plunger during the downstroke to reduce the load on a valve plate.

It is also an object and feature of the subject invention to provide an enhanced piston assembly in a reciprocating compressor wherein a load absorbing element is included without altering the basic configuration of the assembly such that the enhanced piston will fit into the original compressor bore.

It is a further object and feature of the subject invention to provide an adjustable load absorbing element for adjusting the load absorbing capacity depending on the application.

Other objects and features of the invention will be readily apparent from the accompanying drawings and detailed description of the preferred embodiment.

DESCRIPTION OF THE PREFERRED EMBODIMENTS

The subject invention is shown as installed in a typical reciprocating compressor system. The terms upstroke and downstroke are used for convenience only and mean only whether the valve is closed (upstroke) or open (downstroke). These terms are not intended to refer to the specific orientation of the assembly.

Figure 1:
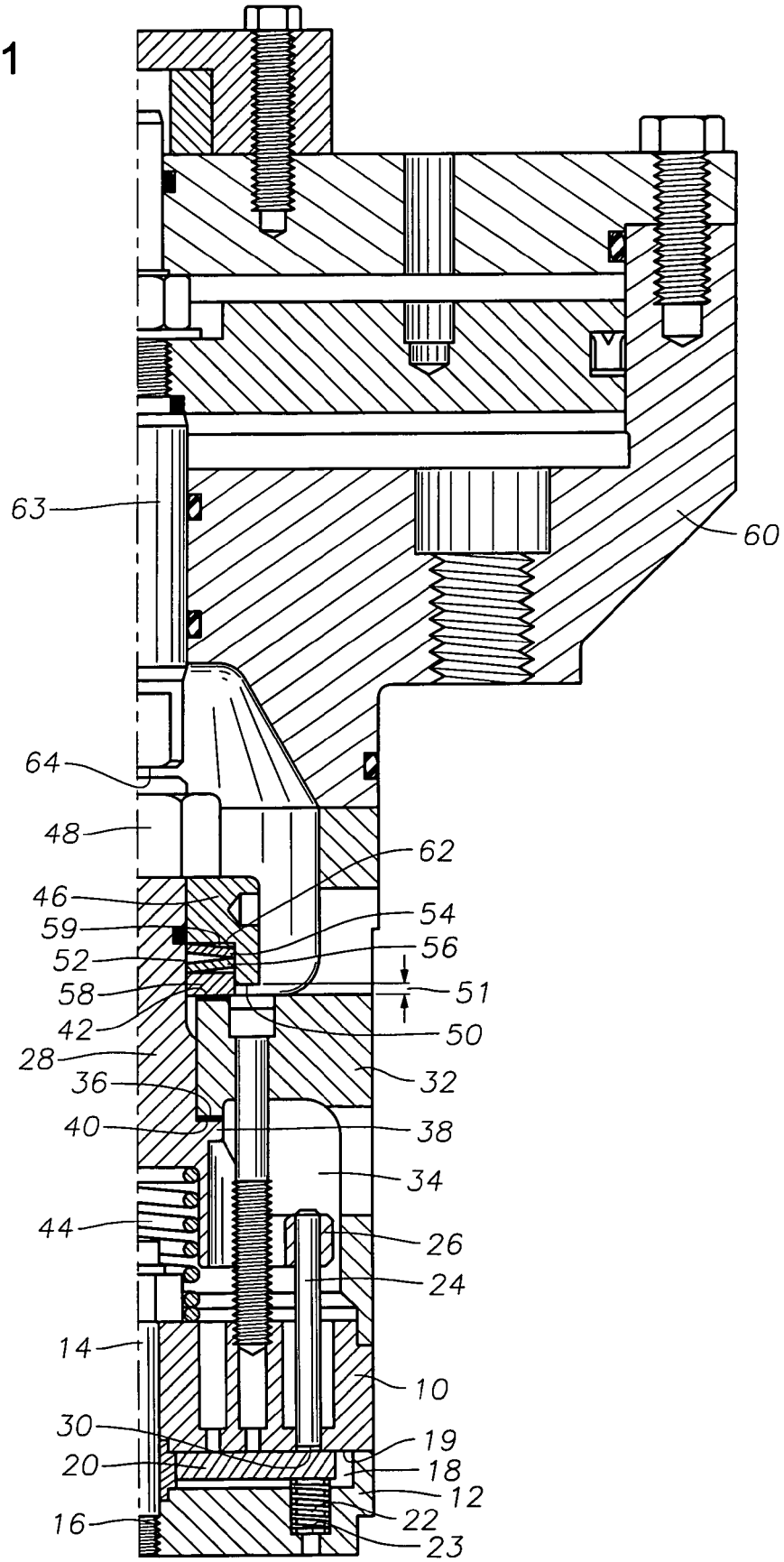
FIG. 1 is a partial cross-sectional view of the bore, piston and valve assembly of a typical reciprocating compressor cylinder shown in the upstroke or valve closed position, with the piston or plunger incorporating the features of the subject invention.

The assembly is shown in the upstroke position in FIG. 1. A cross-section of a valve and cylinder assembly of a compressor is shown and comprises, from the bottom to the top, a lower valve body 10 mounted on a base 12 by suitable means such as the threaded bolt 14 passing through the valve body and into threads 16 in the base 12. The valve body is configured such that a gap or cavity 18 is provided between the base 12 and the seating surface 19 of the valve body. A valve plate 20 is positioned in the cavity and moves between the closed or "up" position of FIG. 1 and the open or "down" position of FIG. 2. A set of compression springs 22 are mounted in spring seats 23 provided in the valve body for normally urging the valve plate into the closed position of FIG. 1.

The valve plate is driven to the open position by the drive fingers 24 which are mounted in the plunger assembly on the outer flange 26 of the plunger 28, as shown. In a typical installation, there is a gap between the lower end 30 of the finger and the valve plate 20. This will cause the finger to "slam" into the valve plate particularly in high speed, high pressure applications and can cause premature fatigue and failure of the valve plate since the valve plate is typically made of a softer material than the finger and since all of the downstroke force is concentrated in the cross-sectional area of the finger 24.

The subject invention is specifically directed to reducing the stress on the valve plate by distributing some of the finger load to a shock absorbing assembly, as described herein.

The finger and plunger assembly is mounted in the cage 34 of body 32. The body 32 includes an upstroke stop surface 36 for engaging the plunger flange 38 and limiting the upstroke movement of the plunger. Typically a wear element 40 is provided on the flange 38. The body 32 also includes a downstroke stop surface 42 for controlling the downstroke movement of the plunger. A compression spring or finger return spring 44 urges the plunger/finger assembly into the upstroke position.

In the preferred embodiment of the invention, an outer ring 46 of C-cross section is mounted on the upper end of the plunger assembly and may be secured in position by the plunger nut 48. The lower rim 50 of the outer ring 46 engages the stop surface 50 to control the downstroke limit of the plunger assembly. In this embodiment, the cavity 52, in and defined by the ring 46, houses the shock absorbing element of the subject invention.

In the preferred embodiment, the shock absorbing element comprises one or more Belleville-type spring washers 54, 56, and a block washer 58 for spacing. When the plunger assembly is in the upstroke position of FIG. 1, the washers are fully expanded. A gap 59 between the expanded washers and the inner surface 62 of the ring is generally provided to assure full expansion of the washers. Typically, this gap is smaller than the gap between the finger end 30 and the valve plate 20 to assure that the shock absorbing element is functioning before the finger engages the valve plate.

Figure 2:
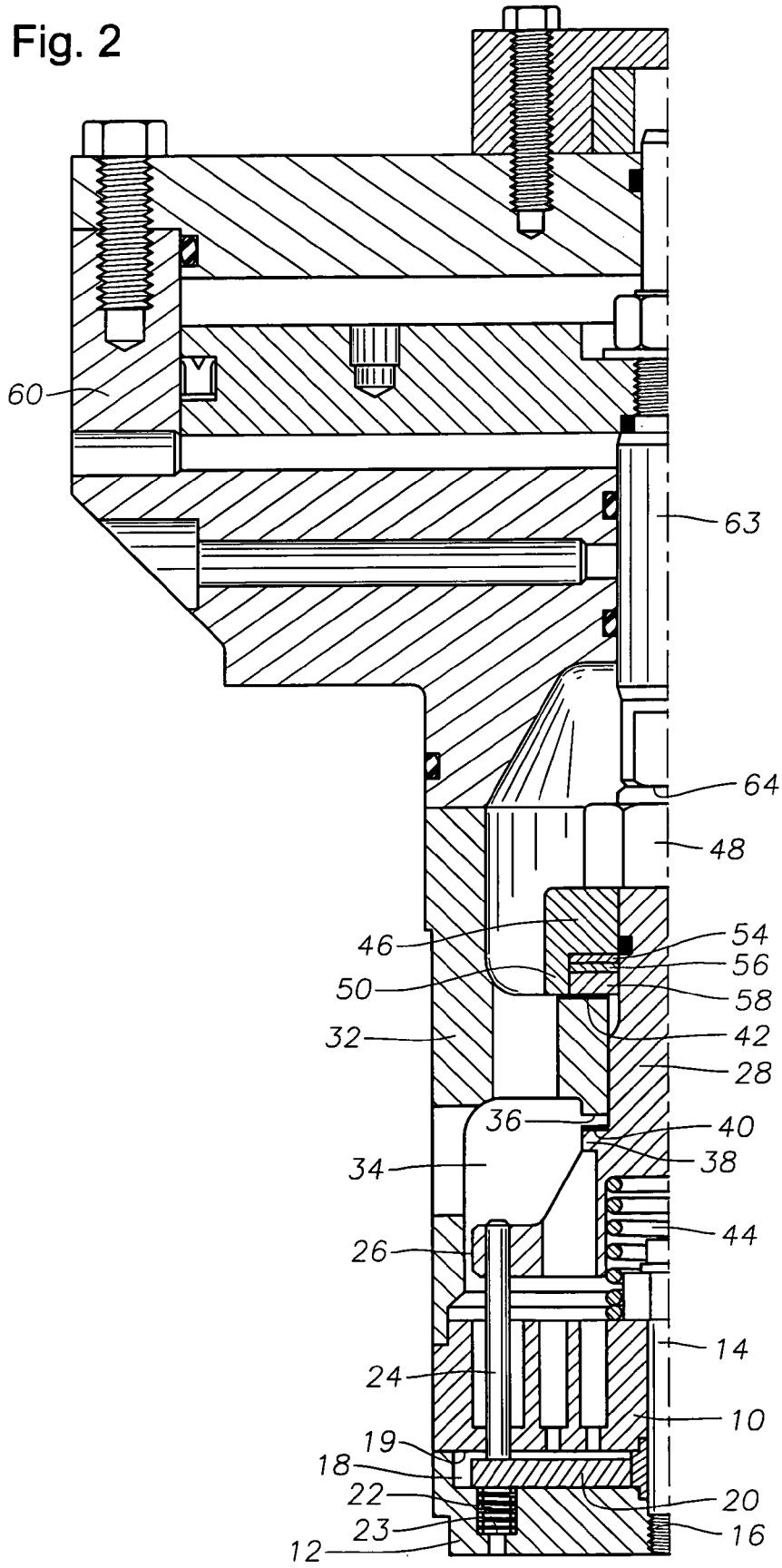
FIG. 2 is a view similar to FIG. 1, and is the mirror image thereof, showing the assembly in the downstroke or valve opened position.

When the plunger assembly is in the downstroke position of FIG. 2, the cavity 52 closes and the washers are compressed as the lower rim 50 of the ring moves down to a preset gap width 51.

This entire assembly is mounted on the compressor body 60 with the plunger assembly in axial alignment with the piston 63. As the piston reciprocates between the upstroke position of FIG. 1 and the downstroke position of FIG. 2, the lower end 64 of the piston engages and drives the plunger, moving the finger for driving the valve plate 20 from the closed position (FIG. 1) to the open position (FIG. 2).

It is an important aspect of the invention that as the plunger assembly moves from the position of FIG. 1 to the position of FIG. 2, the cavity 52 is reduced causing the gap 59 to close and the inner surface of the ring to engage and compress the washers 54, 56. This absorbs some of the load placed on the plunger by the driving force of the piston and thereby reduces the load carried by the drive finger 24 and transferred to the valve plate 20. The shock absorbing system of the invention thus reduces the stress on the valve plate, increasing its life and minimizing stress fatigue.

While certain embodiments and features of the subject invention have been described in detail herein, it should be understood that the invention includes all enhancements and modifications within the scope and spirit of the following claims.

What is claimed is:

1. A valve assembly for a reciprocating compressor, the valve assembly comprising:

a. a valve plate movable between a first position and a second position, b. a plunger adapted to be loaded with a driving force for driving a valve driver, said plunger having a first end and a second end, c. the valve driver being carried directly by the plunger at the second end for engaging the valve plate and moving it from one position to the other, and d. a shock absorbing element carried by the plunger at the first end for absorbing a portion of the driving force for reducing the force carried by the driver and translated to the valve plate.

2. The valve assembly of claim 1, further comprising a return spring engaging said plunger and disposed to provide a force on said plunger counter to said driving force, and wherein the shock absorbing element comprises a compression element mounted on the plunger.

3. The valve assembly of claim 1, wherein the plunger comprises a first end and a second end, wherein said shock absorbing element is carried by the first end of said plunger and said valve driver is carried by the second end of said plunger.

4. The valve assembly of claim 2, wherein the compression element is secured to said plunger so as to move in conjunction with the plunger upon actuation by said-driving force.

5. The valve assembly of claim 1, wherein the plunger comprises:

a. a housing, the housing having a cavity; and b. wherein said shock absorbing element is in the cavity.

6. The valve assembly of claim 5, wherein the shock absorbing element comprises a compression spring component.

7. The valve assembly of claim 6, wherein the compression spring component is a washer.

8. The valve assembly of claim 7, wherein the compression spring is a plurality of wave washers.

9. The valve assembly of claim 7, wherein the compression spring is a plurality of conical washers.

10. The valve assembly of claim 7, wherein the compression spring component is a plurality of Belleville-type spring washers in stacked, opposing assembly.

11. The valve assembly of claim 6, the shock absorbing element further including a fixed spacer to fill a portion of the cavity.

12. The valve assembly of claim 6, wherein the shock absorbing element, when fully expanded, is smaller than the cavity, thereby creating a load gap between the shock absorbing element and the housing.

13. The valve assembly of claim 12, wherein there is a driver gap between the driver and the valve plate when the valve plate is in its normal position.

14. The valve assembly of claim 13, wherein the load gap is smaller than the driver gap.

15. The valve assembly of claim 1, further comprising a piston for providing the driving force applied to said plunger.

16. The valve assembly of claim 2, wherein said plunger is movable between a first position in which the return spring is under compression and the shock absorbing element is uncompressed to a second position where said return spring and said shock absorbing element are under compression.

17. The valve assembly of claim 5, wherein said housing is integrally formed with said plunger.

18. A valve assembly for a reciprocating compressor, the valve assembly of the type having a valve plate movable between a closed position and an open position, a valve driver for engaging the valve plate and moving it from one position to the other and a plunger adapted to be loaded with a driving force for driving the driver, the valve assembly further including a shock absorbing element associated with the plunger for absorbing a portion of the driving force for reducing the force carried by the driver and translated to the valve plate, the shock absorbing element comprising:

a. a housing carried by the plunger, the housing having a cavity;

b. a stop surface engaging abutment; and c. a shock absorbing element in the cavity.

19. The valve assembly of claim 18, wherein the shock absorbing element comprises a compression spring component.

20. The valve assembly of claim 19, wherein the compression spring component is a Belleville-type spring washer.

21. The valve assembly of claim 19, wherein the compression spring component is a plurality of Belleville-type spring washers in stacked, opposing assembly.

22. The valve assembly of claim 19, wherein the shock absorbing element further comprises a fixed spacer to fill a portion of the cavity.

23. The valve assembly of claim 19, wherein the shock absorbing element, when fully expanded, is smaller than the cavity, thereby creating a load gap between the shock absorbing element and the housing.

24. The valve assembly of claim 23, wherein there is a driver gap between the driver and the valve plate when the valve plate is in its normal position.

25. The valve assembly of claim 24, wherein the load gap is smaller than the driver gap.

26. A valve assembly for a reciprocating compressor, the valve assembly of the type having a valve plate movable between a closed position and an open position, a valve driver for engaging the valve plate and moving it from one position to the other and a plunger adapted to be loaded with a driving force for driving the driver, the valve assembly further comprising:

a. a shock absorbing element carried by the plunger, the shock absorbing element comprising a compression element mounted on the plunger and adapted to be compressed as the plunger is driven;

b. the plunger comprising a shaft having one end adapted for being engaged and driven in an axial motion by a drive force and an opposite end carrying the valve driver, wherein the driven axial motion of the plunger is translated directly to the valve driver; and c. the shock absorbing element further comprising a compressible element mounted on the plunger end opposite the valve driver, said shock absorbing element adapted for engaging a stop surface for controlling the stroke of the plunger, wherein the compressible element is compressed as the plunger is driven.

27. The valve assembly of claim 26, further comprising a plunger assembly comprising:

a. a housing carried by the plunger, the housing having a cavity;

b. a stop surface engaging abutment; and c. a shock absorbing element in the cavity and adjacent the stop surface.

28. The valve assembly of claim 26, wherein the shock absorbing element comprises a compression spring component.

29. The valve assembly of claim 28, wherein the compression spring component is a Belleville-type spring washer.

30. The valve assembly of claim 28, wherein the compression spring component is a plurality of Belleville-type spring washers in stacked, opposing assembly.

31. The valve assembly of claim 27, the shock absorbing element comprising a compression spring component and a fixed spacer to fill a portion of the cavity.

32. A valve assembly for a reciprocating compressor, said valve assembly comprising:

A. A plunger having a first and second end;

B. A housing carried directly by the plunger;

C. A shock absorbing element carried by the housing;

D. A valve plate movable between a first and second position; and

E. A driver carried by the plunger separate from said housing said driver disposed to move said valve plate between the first and second positions.

* * * * *